United States Patent [19]

Murakami et al.

[11] 4,202,756

[45] May 13, 1980

[54] PROCESS FOR THE PRODUCTION OF SOLVENT-REFINED COAL USEFUL AS STARTING MATERIAL FOR OTHER CARBONACEOUS PRODUCTS

[75] Inventors: Hisashi Murakami, Tokyo; Toshikatsu Ohtsubo, Kamishirakawa; Kenji Fukuda, Yamashita; Noriaki Ohnishi, Ogawa, all of Japan

[73] Assignees: Mitsui Mining Co., Ltd.; Mitsui Coke Co., Ltd., both of Tokyo, Japan

[21] Appl. No.: 867,751

[22] Filed: Jan. 9, 1978

[30] Foreign Application Priority Data

Jan. 14, 1977 [JP] Japan ..... 52/2499
Jan. 14, 1977 [JP] Japan ..... 52/2500
Jan. 14, 1977 [JP] Japan ..... 52/2501

[51] Int. Cl.[2] ..... C10G 1/04

[52] U.S. Cl. ..... 208/8 LE; 44/1 B; 208/131; 423/448; 423/449

[58] Field of Search ..... 208/2 R, 8 LE; 423/448, 423/449; 44/1 B

[56] References Cited

U.S. PATENT DOCUMENTS

| | | | |
|---|---|---|---|
| 2,686,152 | 8/1954 | Franke | 208/8 LE |
| 3,932,266 | 1/1976 | Sze et al. | 208/8 LE |
| 4,029,749 | 6/1977 | Murakami | 208/8 LE |
| 4,045,187 | 8/1977 | Brink et al. | 208/8 LE |

*Primary Examiner*—Herbert Levine

[57] ABSTRACT

A process is disclosed for the production of solvent-refined coal useful as a starting material for micromosaic carbonaceous products and having an O/C atomic ratio of 0.040 to <0.046, or useful as a starting material for coarse mosaic carbonaceous products and having an O/C atomic ratio of 0.030 to <0.040 or useful as a starting material for needle like carbonaceous products and having an O/C atomic ratio of less than 0.030. The process comprises dissolving in a hydrocarbon solvent a coal intrinsically having an O/C atomic ratio of 0.030 to <0.055 or a coal pretreated with a solvent, under hydrogen pressure, so as to have an O/C atomic ratio of 0.030 to <0.055, and heating the resultant coal solution under a pressure of hydrogen for a period of time sufficient to form said solvent-refined coal.

15 Claims, No Drawings

PROCESS FOR THE PRODUCTION OF SOLVENT-REFINED COAL USEFUL AS STARTING MATERIAL FOR OTHER CARBONACEOUS PRODUCTS

BACKGROUND OF THE INVENTION (a) Field of the Invention

The present invention relates to a process for the production of solvent-refined coal useful as a starting material for other carbonaceous products. More particularly, the present invention relates to a process for the elective production of a starting material for micromosaic carbonaceous products, coarse mosaic carbonaceous products or needle like carbonaceous products, wherein the starting coal in a solvent is heated under hydrogen pressure for a period of time selected according to the oxygen/carbon (O/C) ratio of the starting coal used and of the product desired.

(b) Description of the Prior Art

In the prior art processes for the production of carbonaceous products, the structure and properties of the resultant carbonaceous products and materials are determined almost exclusively from those of the starting materials. For example, a heavy oil of the petroleum series is used as a starting material for needle like carbonaceous products, while several types of coal are combined into a single starting material for blast furnace coke. In recent years, however, not only did the price of many starting materials increase considerably, but also the quality thereof became noticeably lower, so that supply of acceptable starting carbonaceous materials has been increasingly difficult. Thus, there is a great demand for a process for producing the desired carbonaceous products from easily available starting materials. In particular, there is a great demand for developing a process for the production of micromosaic carbonaceous products, coarse mosaic carbonaceous products and needle like carbonaceous product from coal varieties which are readily available and plentiful, especially brown coal, lignite and the like.

In general, these coals are only slightly susceptible of graphitization. It is known, however, that the degree of coal graphitization can be improved by converting them into solvent-refined coals by hydrogenolyzing the starting coal in a solvent, removing insoluble matters therefrom and then removing the solvent. To obtain the desired carbonaceous products according to the known processes, it is necessary to specify the composition of the solvent-refined coal utilizable as a starting material for the carbonaceous product. Thus, it is a key problem (for obtaining the specific solvent-refined coal) to select the exact composition of the starting coal and the proper hydrogenolysis parameters.

SUMMARY OF THE INVENTION

It is therefore an object of the present invention to provide an improved process for producing solvent-refined coal as a starting material for the elected carbonaceous products.

It is another object of the present invention to provide an improved process for producing solvent-refined coal which utilizes cheap and plentiful sources of coal, such as brown coal and lignite.

Other objects, features and advantages of the present invention will become apparent more fully from the following detailed description thereof.

The term "solvent-refined coal", therefore, signifies in the present invention the solid matter which is obtained by hydrogenating the starting coal dissolved in a solvent, removing undissolved matter from the resulting reaction mixture and then removing the solvent to recover the solvent-refined coal.

Briefly stated, there is provided a process for the production of solvent-refined coal useful as a starting material for micromosaic carbonaceous products and having an O/C atomic ratio of 0.040 to <0.046; or as a starting material for coarse mosaic carbonaceous products, in which case it has an O/C atomic ratio of 0.030 to <0.040; or as a starting material for needle like carbonaceous products in which case it has an O/C atomic ratio of less than 0.030. The process comprises dissolving in a hydrocarbon solvent a starting coal selected from those intrinsically having an O/C atomic ratio of 0.030 to <0.055 or from coals pretreated with a solvent so as to have the said O/C atomic ratio of 0.030 to <0.055, and then heating the resultant coal solution at a temperature of 380° C. to 450° C. under hydrogen pressure of at least at 10 kg/cm$^2$ gauge (preferably 50–200 kg/cm$^2$) for a period of time critically determined according to the O/C ratio of the starting coal used to form said solvent-refined coal. The temperature range of 380°–450° C. is the one at which the said resultant coal solution has its maximum dissolution rate.

Detailed Description of the Invention

By the term "coals" used herein is meant all kinds of coals including bituminous coal, brown coal, lignite, peat and the like. The term "coals pre-treated with a solvent" is used herein to mean coals obtained by subjecting the coals in a hydrocarbon solvent to a heat treatment under hydrogen pressure until coals of a desired O/C ratio are obtained.

The size of extinction contour of the "micromosaic structure" is less than 10μ. The size of extinction contour of the "coarse mosaic structure" is over than 10μ, and the structure is not fibrously orientated. The "needle like structure" has a fibrous one.

These definitions of the structures are based on the polarized light microscopic observation of the carbonaceous products.

As described above, the degree of graphitization of coals can be improved by hydrogenolyzing the coals in a solvent, removing insoluble matters therefrom and then removing the solvent. In the course of the hydrogenolytic reaction, the amounts of carbon monoxide and carbon dioxide in the gas formed by the hydrogenolysis are increased and the content of oxygen in the solvent-refined coals is consequently decreased. This means that the hydrogenolytic reaction causes a split of aliphatic side chains from the structural unit of the coal and a concurrent cleavage of three-dimensional cross-linked bonds, thus resulting in the deoxygenation of the coal. Consequently, the composition of hydrogen, oxygen and carbon in the solvent-refined coal can be changed at will by selecting the O/C ratio of the starting coal and controlling the conditions for hydrogenolysis. As the value of the O/C atomic ratio in the solvent-refined coal can be regarded as an index to the properties of the resultant carbonaceous products obtained by carbonization or graphitization, the conditions for producing the solvent-refined coal utilizable as starting material therefor will inevitably be determined by specifying the desired carbonaceous products.

The production of solvent-refined coals which are useful as starting materials for the various carbonaceous products may be described as follows: Solvent-refined coals having an O/C atomic ratio of 0.046 to <0.055 are most suitable as starting materials for micromosaic, coarse mosaic and needle like carbonaceous products. Similarly, coals pre-treated with a solvent (hereafter referred to as preliminary solvent-refined coals) obtained by dissolving a coal of different, higher O/C ratio from the above defined one in a solvent and hydrogenolyzing it to have the above defined O/C ratio are equally employable. The coal or the preliminary solvent-refined coal is dissolved in a solvent and treated with pressurized hydrogen at a temperature of 380°–450° C. for a critical period of time from less than 60 minutes to over 120 min. depending on the product selected and/or on the solvent-refined coal desired.

Preliminary solvent-refined coals useful as starting materials may be prepared, for example, by dispersing cheap subbituminous Australian coal into a solvent, elevating the temperature of the dispersion under pressure of hydrogen at a heating rate of about 3° C./minute to 410° C. to dissolve the coal in the solvent, separating insoluble matters from the solution and then removing the solvent. The resulting preliminary solvent-refined coal utilizable in the process of this invention may also be prepared by using, e.g., Australian lignite or domestic (Japanese) bituminous coal in the above mentioned manner. Any other known process for preparing the preliminary solvent-refined coal may be selected at will.

A solution of the above mentioned solvent-refined coal generally shows a maximum dissolution rate which can be calculated by the formula:

$$\frac{(d.a.f.\ \text{coal}) - (\text{insoluble organic matter})}{(d.a.f.\ \text{coal})} \times 100$$

wherein "d.a.f. coal" stands for dry ash-free coal. By continuing the heat treatment over a given period of time, the physical properties of the solvent-refined coal solution are changed in the derection of a decrease of the dissolution rate.

Generally, to obtain the preliminary solvent-refined coal of 0.046 to <0.055 O/C ratio, the coal is pulverized to a suitable particle size and mixed with a tar having a boiling point of 180°–400° C. and obtained by dry distillation of coal, or it is mixed with an aromatic heavy oil of the petroleum series, or with a mixture of the two, so as to form a slurry in which a ratio by weight of coal/solvent is 1:1–1:10. The slurry is heated to 380°–450° C. in the presence of hydrogen kept under a partial pressure of at least 10 kg/cm$^2$G, preferably 50 to 200 kg/cm$^2$G at a heating rate of about 3° C./minute.

The preliminary solvent-refined coal in a solvent is then heated with pressurized hydrogen at 380°–450° C. for a period of time up to less than 60 minutes for micromosaic carbonaceous products, from 60 to 120 min. for coarse mosaic carbonaceous products, and over 120 min. for needle like carbonaceous products. These critical time periods yield, as a result, solvent-refined coals having respectively different O/C ratios, to wit: 0.040 to <0.046, 0.030 to <0.040 and <0.030.

Naturally, it can be seen that, if one starts from a starting coal having an O/C ratio of 0.046 to <0.055, it takes less than 60 min. to obtain a material with an O/C ratio of 0.040–<0.046, 60 to 120 min. to obtain a material with an O/C ratio of 0.030–<0.040, and more than 120 min. to obtain a material with an O/C ratio of <0.030. Similarly: it will take less than 60 min. to obtain a material with an O/C ratio of 0.030–<0.040 starting from a starting coal with an O/C ratio of 0.040–<0.046; it will take less than 60 min. to obtain a material with an O/C ratio of <0.030 starting from a starting coal with an O/C ratio of 0.030–<0.040; and it will take between 60 and 120 min. to obtain a material with an O/C ratio of <0.030 starting from a starting coal with an O/C ratio of 0.040–<0.046. All of the above periods of time require the same other parameters, i.e. a pressure of hydrogen of at least 10 kg/cm$^2$G (preferably 50–200 kg/cm$^2$G) and a temperature of 380°–450° C.

The present invention will now be illustrated in more detail by way of examples. It is construed, however, that the scope of the invention is not limited to these examples.

EXAMPLE 1

In a 1l autoclave equipped with a stirrer were placed 100g of Australian sub-bituminous coal having an O/C atomic ratio of 0.137 and pulverized into particles of 60 mesh and less, and 300 g of a tar oil having a boiling point within the range of 200°–400° C. The mixture was stirred to a slurry. Hydrogen was then introduced under pressure into the autoclave to a pressure of 60 kg/cm$^2$G and the content of the autoclave was heated to 410° C. at a rate of 3.3° C./minute.

The resultant coal solution was divided into Solutions A (control) and B. Solution A was cooled rapidly to room temperature, the content was filtered under reduced pressure and then distilled under vacuum to recover the solvent. Solution B was subjected to continuous hydrogenolysis for 40 minutes at 410° C. and then cooled to room temperature and the content filtered under reduced pressure and then distilled under vacuum to recover the solvent.

Table 1 shows the analytical results of the solvent-refined coals obtained from Solutions A and B. Table 2 shows physical properties of the products obtained by subjecting the solvent-refined coals to a heat treatment conducted at 430° C. for 120 minutes. Table 3 (as a check) shows the true specific gravities of the calcined products obtained by calcining the products of Table 2 at 1350° C. for 60 minutes as well as the lattice constants of the graphitized products obtained by further treating the calcined product at 2800° C. for 60 minutes.

Table 1

| Sample | Dissolution rate (wt. % d.a.f.) | Elementary Analysis (wt. %) C | H | N | S | 0 | O/C |
|---|---|---|---|---|---|---|---|
| A | 74.03 | 86.02 | 6.10 | 1.62 | 0.90 | 5.36 | 0.0467 |
| B | 73.80 | 86.66 | 5.91 | 1.61 | 0.96 | 4.86 | 0.0421 |

Table 2

| Sample | Yield of the heat treated product (wt. %) | * BI (wt. %) | ** QI (wt. %) | Shape | Structure |
|---|---|---|---|---|---|
| A | 81.19 | 90.65 | 77.17 | Foamy | Isotropic |
| B | 85.08 | 89.96 | 78.43 | Lumpy | Micro-mosaic |

* BI . . . Benzene insoluble matters;
** QI . . . Quinoline insoluble matters

Table 3

| Sample | True specific gravity of the produced calcined at 1350° C. for 60 minutes | Lattice constant of the product Graphitized at 2800° C. for 60 minutes (A) |
|---|---|---|
| A | 1.846 | 6.811 |
| B | 2.052 | 6.742 |

As it is evident from Tables 1, 2 and 3, a solvent-refined coal suitable as a starting material for micromosaic carbonaceous materials is not produced according to the procedure A, while it is readily obtained according to the procedure B.

EXAMPLE 2

In a 0.5l autoclave equipped with a stirrer were placed 50 g of Australian lignite pulverized to a particle size of 60 mesh and less and having an O/C atomic ratio of 0.305, and 150 g of a tar oil having a boiling point within the range of 200°–400° C. The mixture was stirred to a slurry. Hydrogen was then introduced under pressure into the autoclave to a pressure of 60 kg/cm$^2$G and the content of the autoclave was heated to 425° C. at a rate of 3.3° C./minute. The resultant coal solution was divided into Solution A and B. Solution A was cooled rapidly to room temperature, the content was filtered under reduced pressure and then distilled under vacuum to recover the solvent. Solution B was subjected to continuous hydrogenolysis for 45 minutes at 425° C. and then cooled to room temperature and the content was filtered under reduced pressure and then distilled under vacuum to recover the solvent.

Table 4 shows the analytical results of the solvent-refined coals obtained from Solutions A and B. Table 5 shows physical properties of the products obtained by subjecting the solvent-refined coals to a heat treatment at 430° C. for 120 minutes. Table 6 shows the true specific gravities of the calcined products obtained by calcining the products at 1350° C. for 60 minutes as well as the lattice constants of the graphitized products obtained by further treating the calcined product at 2800° C. for 60 minutes.

Table 4

| Sample | Dissolution rate (wt. % d.a.f.) | Elementary analysis (wt. %) C | H | N | S | 0 | O/C |
|---|---|---|---|---|---|---|---|
| A | 30.6 | 86.55 | 5.54 | 1.12 | 0.61 | 6.18 | 0.0536 |
| B | 29.5 | 87.08 | 5.74 | 1.12 | 0.77 | 5.29 | 0.0456 |

Table 5

| Sample | Yield of the heat treated product (wt. %) | BI (wt. %) | QI (wt. %) | Shape | Structure |
|---|---|---|---|---|---|
| A | 83.0 | 96.6 | 88.4 | Flaky | Isotropic |
| B | 83.4 | 95.8 | 57.6 | Flaky | Micromosaic |

Table 6

| Sample | True specific gravity of the product calcined at 1350° C. for 60 minutes | Lattice constant of the product graphitized at 2800° C. for 60 minutes (A) |
|---|---|---|
| A | 1.870 | 6.812 |
| B | 2.043 | 6.755 |

EXAMPLE 3

Example 1 was repeated with the exception that Solution B was subjected to continuous hydrogenolysis for 80 minutes.

Tables 7, 8 and 9 are comparable to Table 1–3, respectively.

Table 7

| Sample | Dissolution rate (wt. % d.a.f.) | Elementary analysis (wt. %) C | H | N | S | O | O/C |
|---|---|---|---|---|---|---|---|
| A | 74.03 | 86.02 | 6.10 | 1.62 | 0.90 | 5.36 | 0.0467 |
| B | 73.60 | 87.44 | 5.69 | 1.68 | 0.95 | 4.24 | 0.0364 |

Table 8

| Sample | Yield of the heat treated product (wt. %) | BI (wt. %) | QI (wt. %) | Shape | Structure |
|---|---|---|---|---|---|
| A | 81.19 | 90.65 | 77.17 | Foamy | Isotropic |
| B | 86.16 | 89.91 | 59.94 | Lumpy | Coarse mosaic |

Table 9

| Sample | True specific gravity of the product calcined at 1350° C. for 60 minutes | Lattice constant of the product graphitized at 2800° C. for 60 minutes (A) |
|---|---|---|
| A | 1.846 | 6.811 |
| B | 2.112 | 6.730 |

As it is evident from Tables 7, 8 and 9, a solvent-refined coal suitable as a starting material for coarse mosaic carbonaceous materials is not produced according to procedure A while it is obtained according to procedure B.

EXAMPLE 4

Example 2 was repeated with the Exception that Solution B was subjected to continuous hydrogenolysis for 100 minutes.

Tables 10, 11 and 12 are comparable, respectively, to Tables 4–6 of Example 2.

Table 10

| Sample | Dissolution rate (wt. % d.a.f.) | Elementary analysis C | H | N | S | O | O/C |
|---|---|---|---|---|---|---|---|
| A | 30.6 | 86.55 | 5.54 | 1.12 | 0.61 | 6.18 | 0.0536 |
| B | 29.4 | 87.94 | 5.61 | 1.15 | 0.82 | 4.48 | 0.0382 |

Table 11

| Sample | Yield of the heat treated product (wt. %) | BI (wt. %) | QI (wt. %) | Shape | Structure |
|---|---|---|---|---|---|
| A | 83.0 | 96.6 | 88.4 | Flaky | Isotropic |
| B | 86.5 | 87.6 | 33.1 | Lumpy | Coarse mosaic |

Table 12

| Sample | True specific gravity of the product calcined at 1350° C. for 60 minutes | Lattice constant of the product graphitized at 2800° C. for 60 minutes (A) |
|---|---|---|
| A | 1.870 | 6.812 |

Table 12-continued

| Sample | True specific gravity of the product calcined at 1350° C. for 60 minutes | Lattice constant of the product graphitized at 2800° C. for 60 minutes (A) |
|---|---|---|
| B | 2.105 | 6.739 |

EXAMPLE 5

In a 5l autoclave equipped with a stirrer were placed 500 g of a domestic (Japanese) bituminous coal pulverized to a particle size of 60 mesh and less and with an O/C atomic ratio of 0.053, and 1500 g of a tar oil having a boiling point within the range of 200°–400° C. The mixture was stirred to a slurry.

Hydrogen was introduced under pressure into the autoclave to a pressure of 60 kg/cm$^2$G and the content of the autoclave was heated to 430° C. at a rate of 3° C./minute.

A solvent-refined coal having an O/C atomic ratio of 0.0435 was obtained from the resultant solution of the coal. A solution of the solvent-refined coal in the above-mentioned tar oil was treated with pressurized hydrogen at 430° C. for 45 minutes and cooled to room temperature. The solution was filtered under reduced pressure and distilled under vacuum to recover the solvent whereby a solvent-refined coal was produced.

As it is evident from Table 13, this solvent-refined coal has physical properties suitable as a starting material for coarse mosaic carbonaceous products. Table 14 shows physical properties of the product obtained by subjecting the solvent-refined coal to a heat treatment at 430° for 120 minutes. Table 15 shows the true specific gravity of the calcined product obtained by calcining the product at 130° C. for one hour as well as the lattice constants of the graphitized products obtained by further treating the calcined products at 2800° C. for one hour.

Table 13

| Dissolution rate | Elementary analysis (wt. %) | | | | | |
|---|---|---|---|---|---|---|
| (wt. % d.a.f.) | C | H | N | S | O | O/C |
| 98.2 | 87.40 | 5.43 | 1.97 | 1.40 | 3.80 | 0.0326 |

Table 14

| Yield of the heat treated product (wt. %) | BI (wt. %) | QI (wt. %) | Shape | Structure |
|---|---|---|---|---|
| 89.0 | 75.9 | 14.3 | Lumpy | Coarse mosaic |

Table 15

| True specific gravity of the product calcined at 1350° C. for 60 minutes | Lattice constant of the product graphitized at 2800° C. for 60 minutes (A) |
|---|---|
| 2.099 | 6.727 |

EXAMPLE 6

In a 1 l autoclave equipped with a stirrer were placed 100 g of Australian sub-bituminous coal pulverized to have a particle size of 60 mesh and less and had an O/C atomic ratio of 0.137, and 300 g of a tar oil having a boiling point of 200°–400° C. The mixture was stirred to a slurry.

Hydrogen was introduced under pressure into the autoclave to a pressure of 60 kg/cm$^2$G and the content of the autoclave was heated to 410° C. at a rate of 3.3° C./minutes. The resultant coal solution was subjected to continuous hydrogenolysis at 410° C. for 80 minutes whereby solvent-refined coal A was obtained from the solution by removing the solvent.

The solvent-refined coal aimed at in this example is a starting material for needle coke and it can be produced by subjecting the solvent-refined coal A solution to further hydrogenolysis at 410° C. for another 40 minutes in pressurized hydrogen atmosphere, removing insoluble matters from the solution and then recovering the solvent therefrom.

Table 16 shows the analytical results of the solvent-refined coals obtained from the solution of the solvent-refined coal A and from a solution of the starting material for needle coke. Table 17 shows physical properties of the products obtained by subjecting the solvent-refined coals to a heat treatment conducted at 430° C. for 120 minutes. Table 18 shows the true specific gravities of the calcined products obtained by calcining the products at 1350° C. for 60 minutes as well as the lattice constants of the graphitized products obtained by further treating the calcined products at 2800° C. for 60 minutes.

Table 16

| Sample | Dissolution rate (wt. % d.a.f.) | Elementary analysis (wt. %) C | H | N | S | O | O/C |
|---|---|---|---|---|---|---|---|
| Solvent-refined coal A | 73.60 | 87.44 | 5.69 | 1.68 | 0.95 | 4.28 | 0.0367 |
| Starting material for needle like carbonaceous products | 71.58 | 89.15 | 5.46 | 1.77 | 1.02 | 2.60 | 0.0219 |

Table 17

| Sample | yield of the heat treated product (wt. %) | BI (wt. %) | QI (wt. %) | Shape | Structure |
|---|---|---|---|---|---|
| Solvent-refined coal A | 86.16 | 89.91 | 59.94 | Lumpy | Coarse mosaic |
| Starting material for needle like carbonaceous products | 90.13 | 75.92 | 32.51 | Lumpy | Large spherical |

Table 18

| Sample | True specific gravity of the product calcined at 1350° C. for 60 minutes | Lattice constant of the product graphitized at 2800° C. for 60 minutes (A) |
|---|---|---|
| Solvent-refined coal A | 2.112 | 6.730 |
| Starting material for needle like carbonaceous products | 2.120 | 6.716 |

As it is evident from Tables 16, 17 and 18, a solvent-refined coal suitable as a starting material for needle like carbonaceous products can be produced by subjecting the solvent-refined coal A solution to a hydrogenolysis at 410° C. for 40 minutes.

EXAMPLE 7

Example 2 was repeated with the exception that Solution B was subjected to continuous hydrogenolysis for 150 minutes.

Tables 19, 20 and 21 are comparable, respectively to Tables 4–6 of Example 2.

Table 19

| Sample | Dissolution rate (wt. % d.a.f.) | Elementary analysis (wt. %) C | H | N | S | O | O/C |
|---|---|---|---|---|---|---|---|
| A | 30.6 | 86.55 | 5.54 | 1.12 | 0.61 | 6.18 | 0.0536 |
| B | 28.7 | 89.52 | 5.52 | 1.29 | 0.89 | 2.78 | 0.0233 |

Table 20

| Sample | Yield of the heat treated product (wt. %) | BI (wt. %) | QI (wt. %) | Shape | Structure |
|---|---|---|---|---|---|
| A | 83.0 | 96.6 | 88.4 | Flaky | Isotropic |
| B | 92.5 | 75.2 | 15.9 | Lumpy | Spherical |

Table 21

| Sample | True specific gravity of the product calcined at 1350° C. for 60 minutes | Lattice constant of the product graphitized at 2800° C. for 60 minutes (A) |
|---|---|---|
| A | 1.870 | 6.812 |
| B | 2.119 | 6.717 |

EXAMPLE 8

In a 5 l autoclave equipped with a stirrer were placed 500 g of a domestic (Japanese) bituminous coal pulverized to a particle size of 60 mesh and less and with an O/C atomic ratio of 0.053, and 1500 g of a tar oil having a boiling point within the range of 200°–400° C. The mixture was stirred to a slurry.

Hydrogen was introduced under pressure into the autoclave to a pressure of 60 kg/cm$^2$G and the content of the autoclave was heated to 430° C. at a rate of 3° C./minute.

A solvent-refined coal having an O/C atomic ratio of 0.0435 (which is useful as a starting material for micromosaic carbonaceous products) was obtained from the resultant coal solution.

The coal solution was further treated with pressurized hydrogen at 430° C. for 45 minutes and for 90 minutes whereby Solutions A and B were obtained respectively. Solutions A and B were cooled to room temperature, filtered under reduced pressure and distilled under vacuum to recover the solvent.

Table 22 shows the analytical results of the solvent-refined coals from Solutions A and B. Table 23 shows physical properties of the products obtained by subjecting the solvent-refined coals to a heat treatment at 430° C. for 120 minutes. Table 24 shows the true specific gravities of the calcined products obtained by calcining the products at 1350° C. for one hour as well as the lattice constants of the graphitized products obtained by further treating the calcined products at 2800° C. for one hour.

Table 22

| Sample | Dissolution rate (wt. % d.a.f.) | Elementary analysis (wt. %) C | H | N | S | O | O/C |
|---|---|---|---|---|---|---|---|
| A | 98.2 | 87.40 | 5.43 | 1.97 | 1.40 | 3.80 | 0.0326 |
| B | 98.5 | 88.38 | 5.73 | 1.00 | 1.42 | 3.47 | 0.0295 |

Table 23

| Sample | Yield of the heat treated product (wt. %) | BI (wt. %) | QI (wt. %) | Shape | Structure |
|---|---|---|---|---|---|
| A | 89.0 | 75.9 | 14.3 | Lumpy | Coarse mosaic |
| B | 91.2 | 72.4 | 12.6 | Lumpy | Spherical |

Table 24

| Sample | True specific gravity of the product calcined at 1350° C. for 60 minutes | Lattice constant of the product graphitized at 2800° C. for 60 minutes (A) |
|---|---|---|
| A | 2.099 | 6.727 |
| B | 2.118 | 6.716 |

We claim:

1. Process for the production of solid solvent-refined coal useful as a starting material for carbonaceous products selected from the group consisting of micromosaic carbonaceous products, coarse mosaic carbonaceous products and needle like carbonaceous products which process comprises: dissolving in a hydrocarbon solvent a starting coal selected from the group consisting of coals intrinsically having an oxygen/carbon atomic ratio (O/C) of 0.030 to <0.055 and coals pre-treated with a solvent, under hydrogen pressure, so as to have said O/C atomic ratio of 0.030 to <0.055; heating the resultant coal solution at a temperature of 380°–450° C. in the presence of a hydrogen pressure of at least 10 kg/cm$^2$G for a period of time sufficient to produce a solvent-refined coal selected from one having an O/C atomic ratio of 0.040 to <0.046, one having an O/C atomic ratio of 0.030 to <0.040 and one having an O/C atomic ratio of less than 0.030 removing undissolved matter from the resulting reaction mixture and removing said solvent to recover the solvent-refined coal.

2. The process according to claim 1 wherein said hydrocarbon solvent is selected from the group consisting of coal tars having a boiling point of 180°–400° C., aromatic heavy oils of petroleum series, and mixtures thereof.

3. The process according to claim 1 wherein the pressure of said hydrogen is within the range of 50–200 kg/cm$^2$.

4. The process according to claim 1 wherein the ratio by weight of said coal to said hydrocarbon solvent is within the range of from 1:1 to 1:10.

5. The process according to claim 1 wherein said starting coal has an O/C atomic ratio of 0.046 to <0.055, said heating time is less than 60 minutes and the resultant solvent-refined coal is said one having an O/C atomic ratio of 0.040 to <0.046.

6. The process according to claim 1 wherein said starting coal has an O/C atomic ratio of 0.046 to <0.055, said heating time is within the range of 60 to 120 minutes, and the resultant solvent-refined coal is said one having an O/C atomic ratio of 0.030 to <0.040.

7. The process according to claim 1 wherein said starting coal has an O/C atomic ratio of 0.046 to <0.055, said heating time is more than 120 minutes, and the resultant solvent-refined coal is said one having an O/C atomic ratio of less than 0.030.

8. The process according to claim 1 wherein said starting coal has an O/C atomic ratio of 0.040 to <0.046, said heating time is less than 60 minutes and the resultant solvent-refined coal is said one having an O/C atomic ratio of 0.030 to <0.040.

9. The process according to claim 1 wherein said starting coal has an O/C atomic ratio of 0.040 to <0.046, said heating time is within the range of 60 to 120 minutes and the resultant solvent-refined coal is said one having an O/C atomic ratio of less than 0.030.

10. The process according to claim 1 wherein said starting coal has an O/C atomic ratio of 0.030 to <0.040, said heating time is less than 60 minutes and the resultant solvent-refined coal is said one having an O/C atomic ratio of less than 0.030.

11. Process for the production of solid solvent-refined coal useful as a starting material for carbonaceous products selected from the group consisting of micromosaic carbonaceous products, coarse mosaic carbonaceous products and needle like carbonaceous products, which process comprises: dissolving in a hydrocarbon solvent a starting coal selected from the group consisting of coals intrinsically having an O/C atomic ratio of 0.030 to <0.055 and coals pre-treated with a solvent, under hydrogen pressure, so as to have said O/C atomic ratio of 0.030 to <0.055; heating the resultant coal solution at a temperature of 380°–450° C. under a hydrogen pressure of at least 10 kg/cm$^2$G for a period of time sufficient to produce a solvent-refined coal selected from one having an O/C atomic ratio of 0.040 to <0.046, one having an O/C atomic ratio of 0.030 to <0.040 and one having an O/C atomic ratio of less than 0.030; removing undissolved matter from the resulting reaction mixture; and removing said solvent to recover said solvent-refined coal; said period of time being <60 minutes for said solvent-refined coal having said O/C atomic ratio of 0.040 to <0.046 from said starting coal having atomic ratio of 0.046 to <0.055, 60 to 120 minutes and <60 minutes for said solvent-refined coal having said O/C atomic ratio of 0.030 to <0.040 from said starting coals having said O/C atomic ratios of 0.046 to <0.055 and 0.040 to <0.046, respectively, and <120 minutes, 60–120 minutes and < minutes for said solvent-refined coal having said O/C atomic ratio of less than 0.030 from said starting coals having said O/C atomic ratios of 0.046 to <0.055, 0.040 to <0.046 and 0.030 to 0.040 respectively.

12. The process according to claim 11, wherein said hydrocarbon solvent is selected from the group consisting of coal tars having a boiling point of 180°–400° C., aromatic heavy oils of petroleum series, and mixtures thereof.

13. The process according to claim 11, wherein the pressure of said hydrogen is within the range of 50–200 kg/cm$^2$.

14. The process according to claim 11, wherein the weight ratio of coal hydrocarbon solvent is within the range of from 1:1 to 1:10.

15. The process according to claim 11, wherein said coals pretreated so as to have said O/C atomic ratio of 0.030 to <0.055 are obtained by heating coals in a hydrocarbon solvent to a temperature of 380° C. to 450° C. at a heating rate of from about 3° to about 3.3° C. under a hydrogen pressure of at least 10 kg/cm$^2$G.

* * * * *